United States Patent [19]

Sugiyama et al.

[11] 4,356,027

[45] Oct. 26, 1982

[54] IRON ORE PELLETS CONTAINING MAGNESIUM OXIDE

[75] Inventors: Takeshi Sugiyama; Shoji Shirouchi, both of Kobe; Mamoru Onoda, Miki; Fumikazu Kawaguchi; Isao Fujita, both of Kobe, all of Japan

[73] Assignee: Kobe Steel, Limited, Kobe, Japan

[21] Appl. No.: 182,599

[22] Filed: Aug. 29, 1980

[30] Foreign Application Priority Data

Sep. 3, 1979 [JP] Japan ..... 54-112648

[51] Int. Cl.[3] ..... C22B 1/14

[52] U.S. Cl. ..... 75/0.5 R; 75/3

[58] Field of Search ..... 75/0.5 R, 3–5

[56] References Cited

U.S. PATENT DOCUMENTS 3,235,371 2/1966 Volin et al. ..... 75/3

FOREIGN PATENT DOCUMENTS 596071 4/1960 Canada ..... 75/5

47-31814 11/1972 Japan ..... 75/3

48-120 1/1973 Japan ..... 75/5

OTHER PUBLICATIONS

Translation of Japanese Patent Laid Open No. 31814/72, pp. 1–21, (No date or author).

*Primary Examiner*—Michael L. Lewis

*Attorney, Agent, or Firm*—Oblon, Fisher, Spivak, McClelland & Maier

[57] ABSTRACT

Iron ore pellets having superior reduction and load softening properties in blast furnace operations. The pellets are prepared from a raw material to which is added an amount of magnesia or a MgO feeding source such as that the ratio of MgO to the $SiO_2$ content of the raw material is at least about 0.5 and the CaO content in the raw material is adjusted so that the ratio $CaO/SiO_2$ is less than about 0.05.

4 Claims, 4 Drawing Figures

IRON ORE PELLETS CONTAINING MAGNESIUM OXIDE

BACKGROUND OF THE INVENTION

1. Field of the Invention

This invention relates to an improvement in iron ore pellets utilized as charge material in blast furnace operations.

2. Description of the Prior Art

At present, more than 90% of the iron ore pellets (hereinafter referred to merely as pellets) manufactured in the world as charge material for blast furnaces are acidic pellets produced through burning and hardening selected iron ores. In only a few instances are specific slag components mixed into such acidic pellets. Because of this, the main component of such acidic pellets is $SiO_2$, and in the case of non-select ores, the maximum content of $SiO_2$ would be about 80%, and in raw material for pellets, the amount of $SiO_2$ is generally less than 8 weight %. There are a few acidic pellets containing a large amount of $Al_2O_3$, but these pellets are few compared with pellets containing $SiO_2$. In most instances, the ratio $Al_2O_3/SiO_3$ is less than 0.5 or 0.79 at the maximum. It is usually desirable to keep the $Al_2O_3$ content as low as possible.

When such acidic pellets are charged into a blast furnace, a reduction stagnation could arise under reduction conditions at a high temperature of more than 1100° C. In a reduction stagnation, no reduction occurs at the inside of the pellets. In such a case, the amount of high FeO slag increases in the blast furnace so that slopping, hanging, lowering of gas permeability would likely occur thus causing inefficiency in the blast furnace operation.

Further, if such acidic pellets are subjected to a high temperature load softening test, significant deformation would be observed at a comparatively low temperature of around 1000° C., and a remarkable deformation would be observed at a temperature greater than 1150° C. accompanied by the production of undesirable fused slags. As such a deformation causes gaps among the lower layers of pellets in the blast furnace, a number of iron layers having poor gas permeability are formed and at the same time, blocking of ore layers could easily occur because of the formation of fused slags, thereby sharply reducing efficiency of operations of the blast furnace.

In recent years, pellets have been modified by the addition of various substances, such as, for example, limestone, which has been utilized alone or in combination with other alkali metal or alkaline earth metal oxides or salts as flux in blast furnace operations for many years. In spite of these numerous modifications, there remains a need, however, for pellets having improved high temperature properties.

SUMMARY OF THE INVENTION

Accordingly, it is an object of the present invention to provide improved iron ore pellets.

It is another object of the invention to provide pellets having an improved high temperature reduction property.

It is a further object of the invention to provide pellets having improved load softening at high temperature.

These and other objects as will hereinafter become clearer from the following discussion and drawings have been attained by adding to the raw material for pellets magnesia or a source thereof in certain proportion to the silicon dioxide content of the raw material and adjusting the calcium oxide content of the raw material to a pre-determined level with regard to the silicon dioxide content.

DETAILED DESCRIPTION OF THE INVENTION

The present invention relates to improved iron ore pellets having exceptional high temperature properties.

According to the present invention, magnesia, i.e. magnesium oxide, is added to the raw material for pellets thereby improving the reduction and the softening property of the pellets under high temperatures. In addition to magnesias, a MgO feeding source, i.e. a material which forms MgO upon burning, for example, magnesite ($MgOO_3$), brucite ($Mg(OH)_2$), sea water mag ($Mg(OH)_2$) and magensia brick slag may likewise be utilized. The selection of a MgO feeding source may be determined according to prevailing prices, but in general, magnesites may be used as well as other minerals containing Mg which may be combined with said MgO feeding source. The MgO content of the raw material is not determined as an absolute amount of MgO, but is preferably determined in relation to the amount to $SiO_2$ contained in raw material. It is preferred in accordance with the invention to adjust the MgO content of the raw material so that the ratio $MgO/SiO_2$ is greater than 0.5.

As previously stated, $SiO_2$ is contained much as vein-stuff of raw material for pellets and the maximum amount of $SiO_2$ in natural ores can be as high as 80 weight %, however, in general, it is less than about 8 weight %. The reduction property and the load softening property at high temperature of pellets produced from raw material containing a large amount of $SiO_2$ is poor and therefore, these properties have been improved by adding MgO thereto in accordance with the invention.

With regard to MgO containing pellets which contain a comparatively large amount of $SiO_2$, CaO has a tendency to increase the amount of low melting point slags formed in the blast furnace. Therefore, it is preferred to reduce the amount of CaO as much as possible in order to maintain an excellent high temperature reduction property. It has been found in accordance with the present invention that it is necessary to keep the basicity, i.e. the $CaO/SiO_2$ ratio of the pellets less than 0.5.

In addition, raw materials may contain a small amounts of $Al_2O_3$ as a vein-stuff. However, the presence of $Al_2O_3$ has little effect in the component system wherein the content of CaO is adjusted to a basicity of 0.05 as described above. However, it is preferred that $Al_2O_3$ content be low so as not to increase slag production.

In accordance with the present invention, improved iron ore pellets are prepared having pre-determined levels of magnesia and calcium oxide in relation to the silicon dioxide content of the raw material. It is essential that the relative magnesia content of the pellets be substantially greater than the calcium oxide. Specifically, the pellets of the invention are prepared from raw material to which sufficient magnesia or a MgO feeding source is added to achieve a $MgO/SiO_2$ ratio of at least about 0.5 wherein the iron ore in the raw material contains 30 weight % or less $SiO_2$. The basicity, i.e. the ratio $CaO/SiO_2$ is likewise adjusted to be less than about 0.05.

The advantages of the improved pellets of the invention can be readily appreciated from the following experiment.

Magnesite, limestone and silica sand were added to specular-hematite so as to produce pellets having various $SiO_2$ amounts, $MgO/SiO_2$ ratios and $CaO/SiO_2$ ratios, and thereafter, reduction property and a softening-shrinkage property of each pellet at high temperature are determined. A chemical analysis value of each pellet is shown in the table below.

| Sample No. | Total Fe | FeO | $SiO_2$ | MgO | CaO | $Al_2O_3$ | $MgO/SiO_2$ | $CaO/SiO_2$ |
|---|---|---|---|---|---|---|---|---|
| 1 | 66.20 | 0.14 | 4.40 | 0.08 | 0.10 | 1.04 | 0.01 | 0.02 |
| 2 | 65.27 | 0.19 | 4.14 | 1.08 | 0.11 | 0.96 | 0.25 | 0.03 |
| 3 | 64.40 | 0.22 | 4.51 | 2.65 | 0.13 | 1.01 | 0.59 | 0.03 |
| 4 | 63.36 | 0.26 | 4.55 | 4.11 | 0.16 | 0.96 | 0.90 | 0.04 |
| 5 | 62.69 | 0.26 | 4.51 | 5.50 | 0.18 | 0.97 | 1.22 | 0.04 |
| 6 | 68.81 | 0.12 | 8.29 | 0.08 | 0.08 | 0.93 | 0.01 | 0.01 |
| 7 | 61.46 | 0.18 | 8.30 | 1.86 | 0.13 | 0.92 | 0.22 | 0.02 |
| 8 | 59.76 | 0.26 | 8.33 | 5.84 | 0.19 | 0.98 | 0.70 | 0.02 |
| 9 | 58.00 | 0.32 | 8.28 | 8.36 | 0.23 | 0.89 | 1.01 | 0.03 |
| 10 | 56.14 | 0.37 | 8.41 | 11.14 | 0.29 | 0.91 | 1.32 | 0.03 |
| 11 | 66.57 | 0.17 | 2.20 | 1.36 | 0.12 | 0.92 | 0.62 | 0.05 |
| 12 | 61.85 | 0.27 | 5.97 | 4.14 | 0.17 | 0.98 | 0.69 | 0.03 |
| 13 | 61.56 | 0.43 | 5.99 | 4.44 | 0.55 | 0.91 | 0.74 | 0.09 |
| 14 | 61.20 | 0.86 | 5.96 | 4.54 | 1.02 | 0.93 | 0.76 | 0.17 |
| 15 | 60.85 | 1.87 | 5.99 | 4.58 | 1.51 | 0.89 | 0.76 | 0.25 |
| 16 | 58.68 | 4.28 | 7.23 | 4.87 | 3.27 | 1.34 | 0.67 | 0.45 |
| 17 | 56.90 | 4.08 | 7.40 | 4.54 | 6.03 | 1.28 | 0.61 | 0.81 |
| 18 | 56.58 | 3.61 | 6.09 | 4.64 | 7.68 | 0.91 | 0.76 | 1.26 |
| 19 | 65.5 | 0.26 | 3.18 | 2.95 | 0.34 | 0.48 | 0.93 | 0.11 |

To determine reduction under a high temperature, sample pellets were reduced preliminary to wuestite (FeO) at 900° C. under a reduction atmosphere of $CO/CO_2=60/40$ and thereafter, further reduced for two hours at 1250° C. reduction temperature under a reduction gas atmosphere of $CO/N_2=80/70$. The reduction ratio was then determined.

Further, as regards a load softening test under high temperature, the sample pellets were placed between alumina rods and 0.5 kg/pellet load applied thereto so as to raise the temperature. The temperature was raised continuously up to melting temperature at 10° C./min velocity, introducing $CO/N_2=80/70$ from 400° C.

During this process, at the 1000° C. stage, the pellets were maintained for 90 minutes. As the temperature was raised, the temperature showing 40% of shrinkage was noted. This is important because a rapid compression loss is indicated when the shrinkage percentage is over 40% in a load softening test of filling layers, and it is preferable that the shrinking percentage at the time of melting is kept less than 40%.

The result of the above-described experiment is shown in the accompanying drawings in which.

Figure 3:
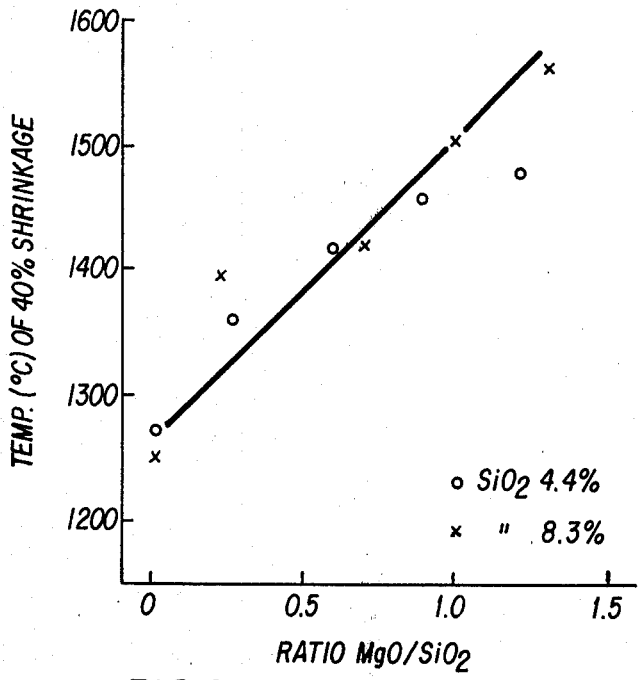
Figure 4:
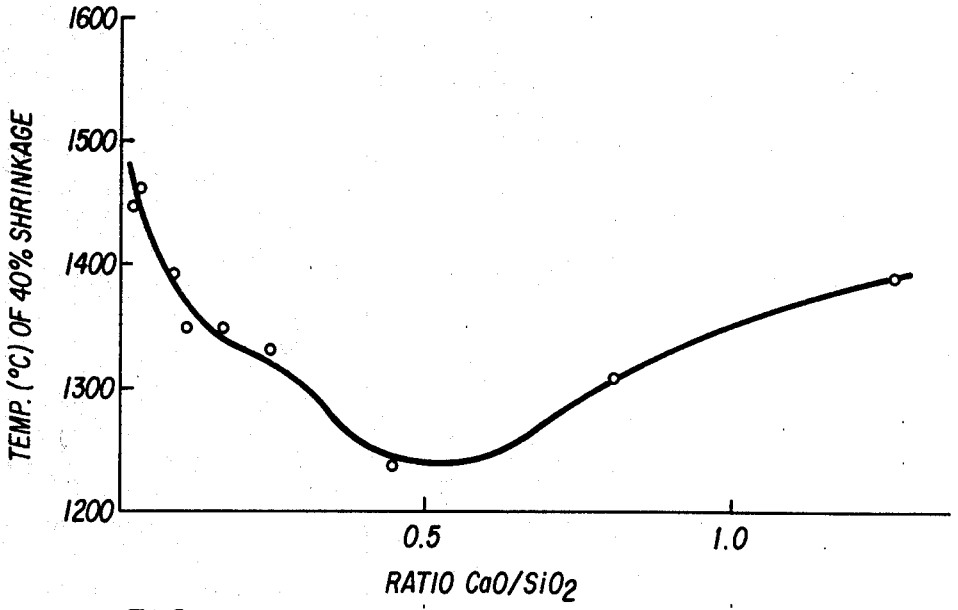

FIG. 3 is a graph showing the relation between $MgO/SiO_2$ ratio and 40% shrinkage temperature with the $SiO_2$ content at 4.4% and 8.8%, respectively; and FIG. 4 is a graph showing the relation between $CaO/SiO_2$ ratio and 40% shrinkage temperature wherein the $MgO/SiO_2$ ratio is approximately 0.72.

Figure 1:
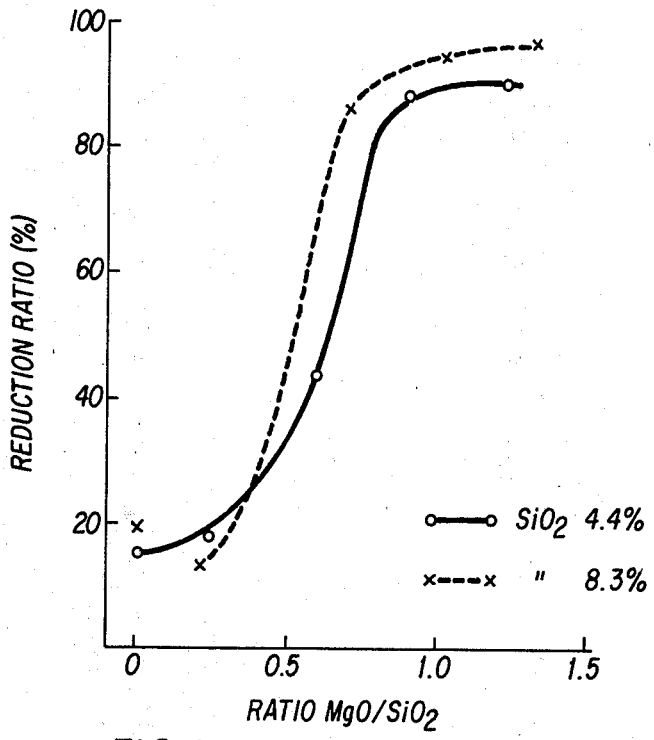
FIG. 1 is a graph showing $MgO/SiO_2$ ratio and reduction ratio when $SiO_2$ is limited to fixed quantities of 4.4% or 8.3%.

In FIG. 1, it can be seen that the reduction ratio is remarkably influenced by the $MgO/SiO_2$ ratio, and the influence of the $SiO_2$ content is slight. In general, a reduction ratio at which no reduction stagnation occurs is about 40% (after two hours at 1250° C.). In order to obtain this desired reduction ratio, it is necessary that the $MgO/SiO_2$ ratio be at least 0.5. Further, if $MgO/SiO_2$ ratio is more than 0.7, it would be possible to obtain a high reduction ratio of more than 80%.

Figure 2:
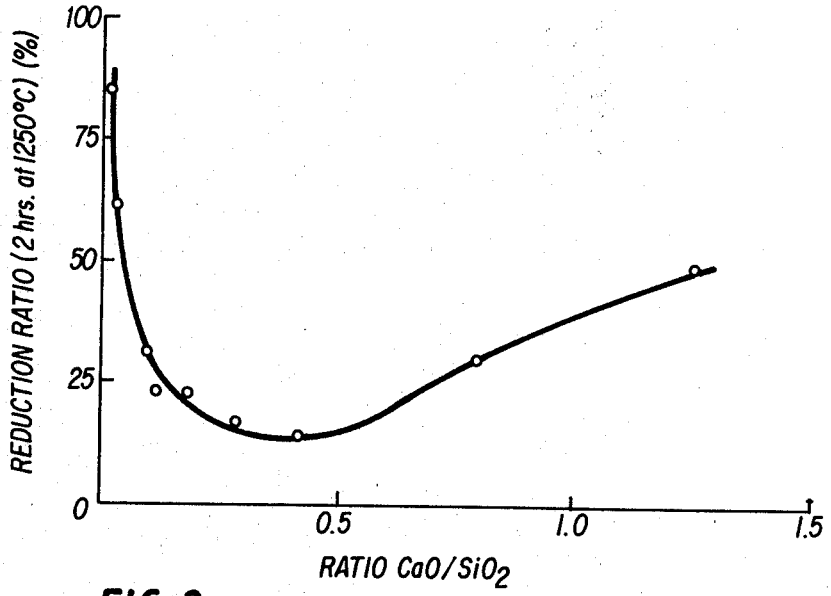
FIG. 2 is a graph showing the relation between $CaO/SiO_2$ ratio wherein the $MgO/SiO_2$ ratio is within about 0.6–0.76 in terms of the reduction ratio.

As clearly can be seen from the results shown in FIG. 2 as the $CaO/SiO_2$ ratio in the pellets is raised substantially above zero, the reduction ratio drops rapidly and the reduction ratio indicates the minimum value at around 0.3–0.5. If $CaO/SiO_2$ ratio is raised further, the reduction ratio gradually elevates.

In order to secure a reduction ratio of more than 40% which is deemed necessary to prevent reduction stagnation, it can be seen that the $CaO/SiO_2$ ratio should be less than 0.05 or more than 1.1. However, if the amount of CaO is too large, the amount of slags increases remarkably in ores containing a large amount of $SiO_2$, thereby productivity is lowered. Thus, according to the present invention, the condition under which the $CaO/SiO_2$ ratio would be more than 1.1 is not desirable.

With regard to the high temperature load softening test of FIG. 3, platinum plates were provided above and below a sample pellet so as to prevent reactions with other substances. However, when the same test has been carried out by providing carbon plates with due regard to actual states in a blast furnace, carbon enters thereinto, thus almost all the pellets have melted down around 1400° C. In view of this, when the results shown in FIG. 3 are taken into consideration, it is concluded that the conditions wherein the temperature showing 40% shrinkage should at least be higher than about 1400° C., i.e. wherein the $MgO/SiO_2$ ratio is about 0.05 or above.

In FIG. 4, it can be seen that, with a fixed $MgO/SiO_2$ ratio, raising the ratio substantially above zero causes a rapid drop in the 40% shrinkage temperature to a minimum 0.4, after which it will show again a rising tendency.

In any event, in order to raise the 40% shrinkage temperature to above 1400° C., it is necessary to make the $CaO/SiO_2$ ratio about 0.05 or less.

As clearly can be seen from the results shown in FIGS. 1–4, the influence of the $MgO/SiO_2$ ratio and the $CaO/SiO_2$ upon high temperature reduction property and high temperature load softening property is in inverse proportion. If pellets prepared in accordance with the invention having a $MgO/SiO_2$ ratio of at least about 0.5 and a $CaO/SiO_2$ ratio less than above 0.05, it would be possible to provide excellent pellets having these two efficiencies.

The pellets of the present invention are highly advantageous in that their soft shrinkage rate at high temperature and their high temperature load softening property are excellent and therefore, it is possible to obtain good air-permeability while at the same time, as they have an excellent reduction property, reduction proceeds in the high temperature zones of the furnace, thereby preventing reduction stagnation. Further, the amount of molten slags produced is less and no molten slags ooze from the pellets. Therefore, air-permeability into layers of ores in a blast furnace is maintained in high temperature regions, thus allowing a large amount of gas to be blown into the charge. Accordingly, a lowering of coke ratio and elevation of the ratio of pig iron in the charge is possible.

In comparison to conventional limestone self-soluble pellets wherein, for example, the $CaO/SiO_2$ ratio is 1.3 or above, the amount MgO added to the pellets of the present invention is small and further, as the amount CaO is controlled to be very small, it is possible to reduce the cost of raw material for pellets of the invention. In particular, the pellets of the present invention can be used advantageously in areas where limestone is difficult to obtain locally. If the $MgO/SiO_2$ ratio and the $CaO/SiO_2$ ratio of pellets are adjusted properly in accordance with the invention, there would be no influence upon high temperature reduction property even if the $SiO_2$ content be varied slightly. It therefore follows that, in accordance with the present invention, pellets having an excellent high temperature reduction property can be obtained from acidic pellet raw materials in which it is difficult to reduce the $SiO_2$ content.

What is claimed as new and intended to be covered by Letters Patent is:

1. Iron ore pellets which are formed by admixing an iron ore containing 8.41% or less of $SiO_2$ with a sufficient amount of magnesia or MgO feeding source to provide a ratio of MgO to $SiO_2$ of at least about 0.5, such that the basicity, expressed as the ratio of calcium oxide to $SiO_2$, is less than the about 0.05.

2. The iron ore pellets of claim 1, wherein the ratio of MgO to $SiO_2$ is at least about 0.7.

3. The iron ore pellets of claim 1, wherein the MgO feeding source is selected from the group consisting of magnesite, brucite, sea water mag and magnesia brick slag.

4. The iron ore pellets of claim 3, wherein the MgO feeding source is a magnesite.

* * * * *